United States Patent [19]

Araki

[11] Patent Number: 4,658,182

[45] Date of Patent: Apr. 14, 1987

[54] IMAGE PICK-UP TUBE

[75] Inventor: Shoji Araki, Kanagawa, Japan

[73] Assignee: Sony Corporation, Tokyo, Japan

[21] Appl. No.: 607,766

[22] Filed: May 7, 1984

[30] Foreign Application Priority Data

May 12, 1983 [JP] Japan ..... 58-82995

[51] Int. Cl.[4] ..... H01J 31/00

[52] U.S. Cl. ..... 313/384; 313/382

[58] Field of Search ..... 313/432, 436, 437, 439, 313/450, 376, 382, 383, 384, 389, 390

[56] References Cited

U.S. PATENT DOCUMENTS

| | | | |
|---|---|---|---|
| 2,681,426 | 6/1954 | Schlesinger | 313/436 |
| 2,740,918 | 4/1956 | James et al. | 313/382 |
| 2,830,228 | 4/1958 | Schlesinger | 313/439 |
| 3,225,240 | 12/1965 | Sybeldon | 313/390 |
| 3,952,227 | 4/1976 | Van Alphen | 313/432 |
| 4,348,617 | 9/1982 | Miyazaki | 313/384 |

FOREIGN PATENT DOCUMENTS

| | | | |
|---|---|---|---|
| 0910442 | 6/1946 | France | 313/432 |
| 0121662 | 9/1979 | Japan | 313/439 |

*Primary Examiner*—David K. Moore

[57] ABSTRACT

An image pick-up tube is disclosed which includes an envelope, an electron beam source positioned at one end of the envelope, a target positioned at another end of the envelope opposite to the electron beam source and at least one electrostatic lens positioned between the electron beam source and the target. The lens includes a first electrode and a second electrode respectively deposited on the inner surface of the envelope and a lead electrode connected to the second electrode is deposited on the inner surface of the envelope across the first electrode but isolated therefrom.

4 Claims, 9 Drawing Figures

IMAGE PICK-UP TUBE

BACKGROUND OF THE INVENTION

1. Field of the Invention

The present invention relates generally to an image pick-up tube and particularly to an image pick-up tube which can easily be manufactured and of which the characteristic such as aberration or the like can be improved.

2. Description of the Prior Art

FIGS. 1 and 2 respectively show examples of the prior art image pick-up tube. In FIGS. 1 and 2, reference numeral 1 designate an electron gun and 2 a glass envelope. In FIG. 1, reference characters G3, G4 and G5 respectively designate grid electrodes from which leads 3, 4 and 5 are respectively led out to apply predetermined voltages to the grid electrodes G3, G4 and G5. In FIG. 2, reference characters G3 and G4 respectively designate grid electrodes from which leads 6 and 7 are respectively led out to apply predetermined voltages thereto. In the image pick-up tube shown in FIG. 2, the electrode G4 is formed by, for example, depositing metal on the inner surface of the glass envelope 2.

Since the image pick-up tubes having the configuration shown in FIGS. 1 and 2 each employ the cylindrical electrodes, such prior art image pick-up tubes require a mechanical construction (not shown) to support the cylindrical electrodes and leads must be connected (welded) to the electrodes thereof, thus the manufacturing of the image pick-up tube being made difficult. In such prior art image pick-up tubes, electrostatic lenses are formed between the electrodes. In this case, since the image pick-up tubes having the configuration shown in FIGS. 1 and 2 employ the cylindrical electrodes apart from the inner surface of the envelope 2, the aperture of the electrostatic lens thus formed is smaller than the inner diameter of the glass envelope 2 so that distortion becomes serious and thus the characteristics such as aberration or the like are deteriorated.

OBJECTS AND SUMMARY OF THE INVENTION

Accordingly, it is an object of the present invention to provide an improved image pick-up tube.

It is another object of the present invention to provide an image pick-up tube which can easily be manufactured.

It is a further object of the present invention to provide an image pick-up tube which can reduce distortion.

It is a still further object of the present invention to provide an image pick-up tube which can improve characteristics such as aberration or the like.

According to one aspect of the present invention, there is provided an image pick-up tube comprising:

(a) an envelope;

(b) an electron beam source positioned at one end of said envelope;

(c) a target positioned at another end of said envelope opposite to said electron beam source; and (d) at least one electrostatic lens means positioned between said electron beam source and said target, said lens means comprising a first electrode and a second electrode respectively deposited on the inner surface of said envelope, a lead electrode connected to said second electrode being deposited on the inner surface of said envelope across said first electrode but isolated therefrom.

The other objects, features and advangates of the present invention will become apparent from the following description taken in conjunction with the accompanying drawings through which the like references designate the same elements and parts.

DESCRIPTION OF THE PREFERRED EMBODIMENTS

An embodiment of the image pick-up tube according to the present invention will hereinafter be described with reference to FIGS. 3 to 5. This embodiment concerns an image pick-up tube of an electrostatic focusing-/electrostatic deflection type (a so-called S·S type).

Figure 2:
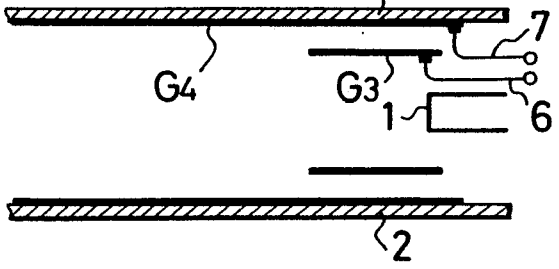
FIG. 2 (PRIOR ART)
FIGS. 1 and 2 are respectively cross-sectional views showing parts of examples of the prior art image pick-up tube.
Figure 1:
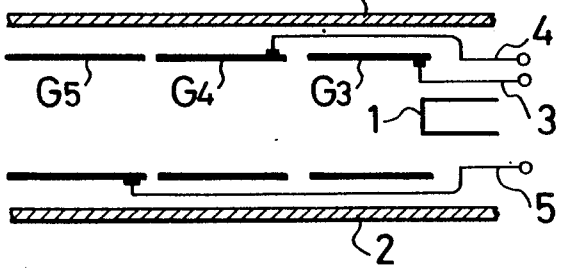
FIG. 1 (PRIOR ART)
Figure 3:
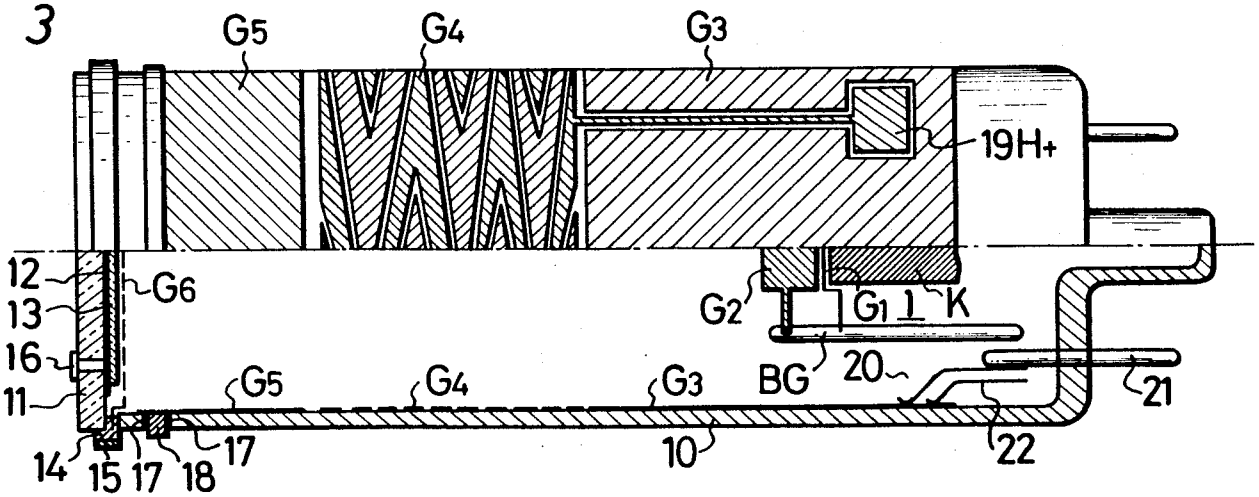
FIG. 3 is a diagram showing an embodiment of the image pick-up tube according to the present invention with its main part being partially cut out.

FIG. 3 is a diagram showing the first embodiment of the invention with its main part being partially cut out. In FIG. 3, reference numeral 10 designates a glass envelope, 11 a face plate provided at its one end, 12 a transparent conductive film (nesa) formed on the inner surface of the face plate 11, 13 a photo conductor or target coated on the transparent conductive film 12, 14 a low temperature sealant made of indium sealing the face plate 11 to the open end of the envelope 10 and 15 a metal ring contacting with the outer surface of the sealant 14. Reference numeral 16 designates a metal electrode connected through the face plate 11 to the transparent conductive film 12 for deriving a signal therefrom. Reference character G6 designates a mesh electrode located to oppose the photo conductor 13 and this mesh electrode G6 is connected through the indium sealant 14 to the metal ring 15. Through this metal ring 15, a predetermined voltage, for example, 950 V is applied to the mesh electrode G6.

In FIG. 3, reference characters K, G1 and G2 respectively designate a cathode and first and second grid electrodes which form an electron gun 1. Reference character BG designates a bead glass by which the cathode K and the first and second grid electrodes G1 and G2 are fixed together.

Also in FIG. 3, reference characters G3, G4 and G5 respectively designate third, fourth and fifth grid electrodes. Each of the electrodes G3, G4 and G5 is formed in such a manner that a metal such as chromium, aluminium or the like is desposited or plated on the inner surface of the glass envelope 10 and removed or cut away to be a predetermined pattern by using, for example, a laser. The electrodes G3, G4 and G5 are used as the focusing electrodes and the electrode G4 is also used as deflection electrode.

The electrode G5 is connected to a ceramic ring 18 which is fixed to a middle portion of, for example, the glass envelope 10 by using a first seal 17 and of which the surface is metal-plated. Through this ceramic ring 18, a predetermined voltage, for example, 500 V is applied to the electrode G5.

Figure 4:
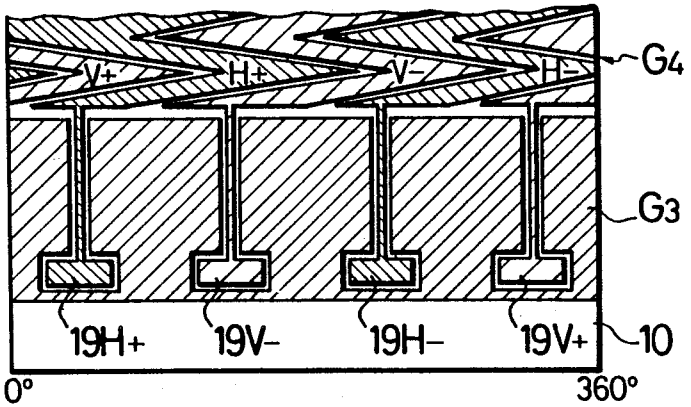
FIG. 4 is a plan view showing a main part of FIG. 3.

The electrodes G3 and G4 are respectively formed as shown by an expansion plan view of FIG. 4. That is, as showin in FIG. 4, the electrode G4 is formed to have a pattern in which four zigzag shaped electrodes $H_+$, $H_-$, $V_+$ and $V_-$ are alternately arranged. Leads 19$H_+$, 19$H_-$, 19$V_+$ and 19$V_-$ led out from the electrodes $H_+$, $H_-$, $V_+$ and $V_-$ are similarly formed on the inner surface of the glass envelope 10 at the same time when these electrodes $H_+$, $H_-$, $V_+$ and $V_-$ are formed thereon. As shown in FIG. 4, these leads 19$H_+$, 19$H_-$, 19$V_+$ and 19$V_-$ are all formed across the electrode G3 but isolated therefrom.

In FIG. 3, reference numeral 20 designates a contactor spring one end of which is connected to a stem pin 21 and the other end of which is made in contact with one of the leads 19$H_+$, 19$H_-$, 19$V_+$ and 19$V_-$. Although only a pair of the contactor sping 20 and the stem pin 21 are shown in FIG. 3, the pair of the contactor spring 20 and the stem pin 21 are provided for each of the leads 19$H_+$, 19$H_-$, 19$V_+$ and 19$V_-$. Through the stem pins 21, the contactor springs 20 and the leads 19$H_+$ and 19$H_-$, a predetermined voltage, for example, a horizontal deflecting voltage symmetrically changing around 13 V in a range from +50 V to −50 V relative to the predetermined voltage is applied across the electrodes $H_+$ and $H_-$ constituting the electrode G4. Moreover, a predetermined voltage, for example, a vertical deflecting voltage changing symmetrically around 13 V in a range from +50 V to −50 V relative to the predetermined voltage is applied across the electrodes $V_+$ and $V_-$ through the corresponding stem pins 21, contactor springs 20 and leads 19$V_+$ and 19$V_-$.

Reference numeral 22 designates a contactor spring one end of which is connected to a stem pin (not shown in FIG. 3) and the other end of which is made in contact with the electrode G3. Through the stem pin and the contactor spring 22, a predetermined voltage, for example, 500 V is applied to the electrode G3.

Figure 5:
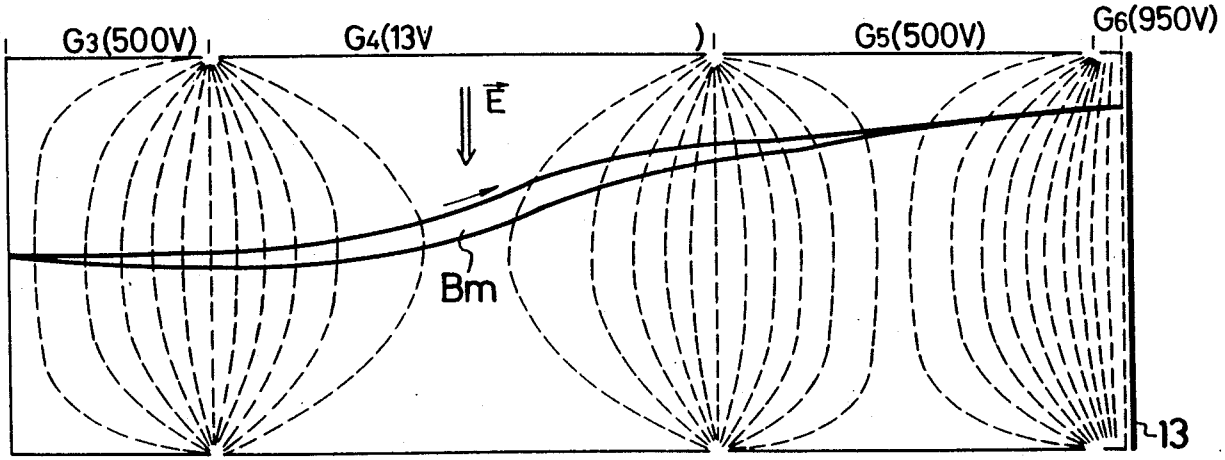
FIG. 5 is a schematic diagram useful for explaining the operation of the embodiment in FIG. 3.

In FIG. 5, broken lines show electrostatic lenses formed among the electrodes G3 to G6 and an electron beam Bm is focused by the electrostatic lenses thus formed. The correction of so-called landing error of the electron beam Bm on the target 13 is carried out by the electrostatic lens formed between the electrodes G5 and G6. In FIG. 5, the electrostatic lenses do not include the deflection electric field $\vec{E}$ generated by the electrode G4.

In this embodiment, the deflection of the electron beam Bm is carried out by the deflection electric field $\vec{E}$ generated by the electrode G4.

As described above, according to this embodiment, since the electrodes G3, G4 and G5 are formed on the inner surface of the glass envelope 10, the mechanical arrangement for supporting them is not required. Moreover, since the leads 19$H_+$, 19$H_-$, 19$V_+$ and 19$V_-$ are similarly formed on the inner surface of the glass envelope 10 at the same time when the electrodes G3, G4 and G5 are formed thereon, such work to connect the leads to the electrodes becomes unnecessary and hence the manufacturing process become easy. Furthermore, since the electrodes are formed on the inner surface of the glass envelope 10, the apertures of the electrostatic lenses formed by these electrodes are substantially equal to the inner diameter of the glass envelope 10 (see FIG. 5) so that the distortion of the electron beam is reduced and the characteristic such as aberration or the like is improved as compared with that of the prior art image pick-up tube.

Figure 7:
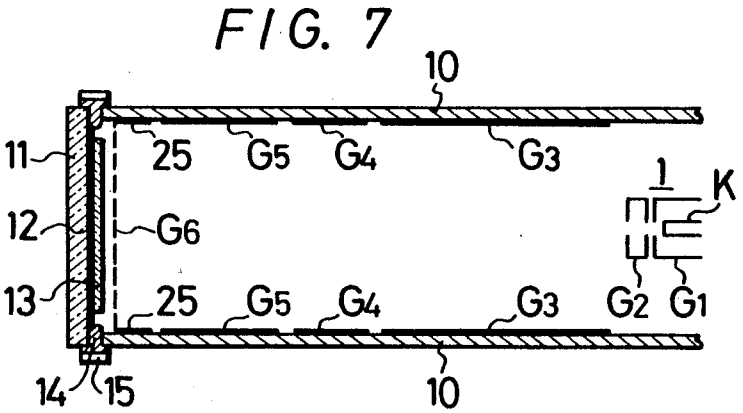
FIGS. 6 and 7 are respectively diagrams showing a main part of other embodiments of the image pick-up tube according to the present invention.
Figure 6:
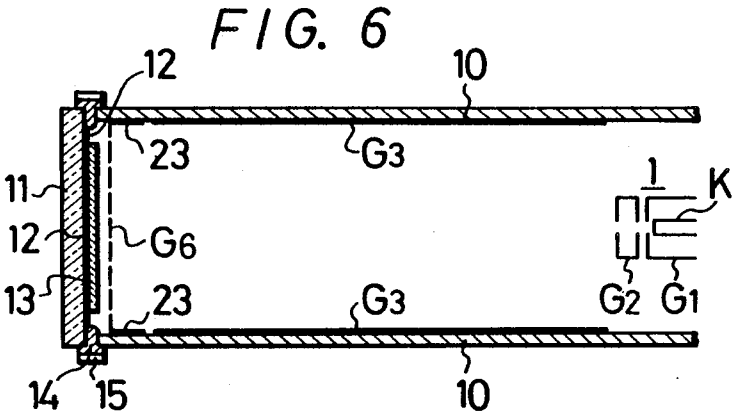

FIGS. 6 and 7 respectively show other embodiments of the present invention. In FIGS. 6 and 7, like parts corresponding to those in FIG. 3 are marked with the same references and will not be described in detail.

Figure 8:
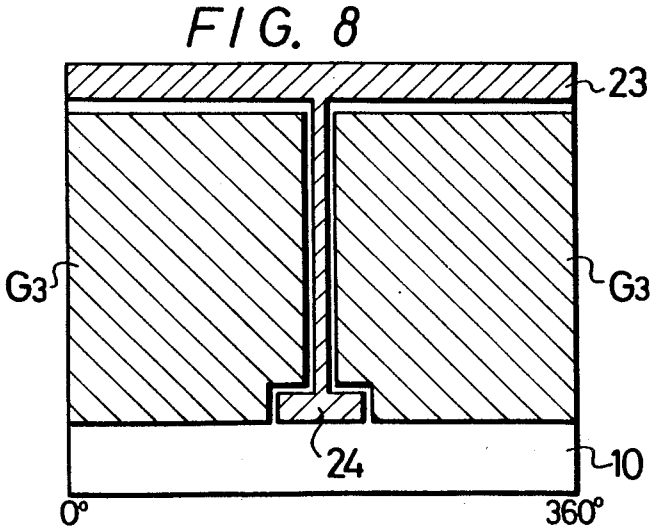

FIG. 6 shows an example of an image pick-up tube of an electromagnetic focusing/electromagnetic deflection type (a so-called M·M type) which does not include the electrodes G4 and G5 different from the example of FIG. 3. Reference numeral 23 designates a contact member of a mesh electrode G6, and G3 a third grid for focusing which is adjacent to the mesh electrode G6 to establish a collimation lens therebetween. A focusing coil, a deflection coil and so on are not shown in FIG. 6 for simplicity. The contact member 23 and the electrode G3 are formed in such a manner that metal such as chromium, aluminium or the like is deposited or plated on the inner surface of the glass envelope 10 and then partially removed or cut out into a predetermined pattern by using, for example, a laser. In this case, as shown by an expansion plan view of FIG. 8 which shows the main part thereof, a lead 24 led out from the contact member 23 is similarly formed on the inner surface of the glass envelope 10 at the same time when the contact member 23 and the electrode G3 are formed thereon. The lead 24 is formed across the electrode G3 but isolated therefrom.

In the embodiment shown in FIG. 6, the contactor spring or the like is used to apply a predetermined voltage to the electrode G3 and also the contactor spring or the like is used to apply a predetermined voltage to the mesh electrode G6 through the lead 24 and the contact member 23.

Figure 9:
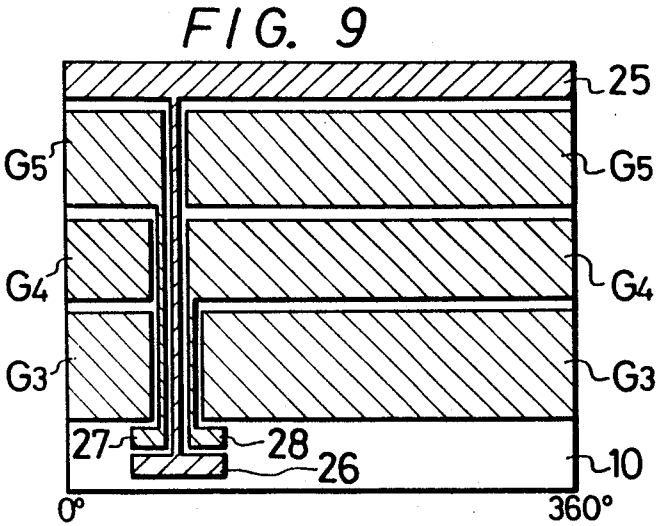
FIGS. 8 and 9 are respectively expansion plan views of main parts of the embodiments of the invention in FIGS. 6 and 7 useful for explaining the same.

FIG. 7 shows an example of the image pick-up tube of electrostatic focusing/electromagnetic deflection type (a so-called S·M type). In FIG. 7, reference numeral 25 designates a contact member of a mesh electrode G6, and reference characters G3, G4 and G5 respectively designate third, fourth and fifth grid electrodes. A deflection coil is not shown in FIG. 7 for simplicity. The contact member 25 and the electrodes G3, G4 and G5 are formed in such a fashion that metal such as chromium, aluminium or the like is deposited or plated on the inner surface of the glass envelope 10 and then partially removed or cut out into a predetermined pattern by using, for example, a laser. In this case, as shown by an expansion plan view in FIG. 9, leads 26, 27 and 28 led out of the contact member 25 and the electrodes G5 and G4 are formed on the inner surface of the glass envelope 10 at the same time when the contact member 25 and the electrodes G3, G4 and G5 are formed thereon. The lead 26 is formed across the electrodes G5, G4 and G3 but isolated therefrom. Furthermore, the lead 27 is formed across the electrodes G4 and G3 but isolated therefrom. In addition, the lead 28 is formed across the electrode G3 but isolated therefrom. The respective leads 26 to 28 are of course isolated one another.

In the embodiment shown in FIG. 7, the contactor spring and so on are used to apply a predetermined voltage to the electrode G3 and also the contactor spring and so on are used to apply a predetermined voltage to the electrodes G4 and G5 through the leads 28 and 27. Further, the contactor spring and so on are used to apply a predetermined voltage to the mesh electrode G6 through the lead 26 and the contact member 25.

Also in the embodiments shown in FIGS. 6 and 7, since the electrodes G3, G4 and G5 and the contact members 23 and 25 are formed on the inner surface of the glass envelope 10 and the leads 24, 26, 27 and 28 are similarly formed on the inner surface of the glass envelope 10 at the same time when the electrodes G3, G4 and G5 and the contact members 23 and 25 are formed thereon, the same action and effect as those in the embodiment shown in FIG. 3 can be established.

While the examples of the voltages applied to the electrodes G3, G4, G5 and G6 in the embodiment shown in FIG. 3 are mere examples, it is needless to say that such voltages are not limited to the voltages of the above example.

As will be clear from the above embodiments, according to the present invention, since the electrodes are formed by depositing the conductive material on the inner surface of the glass envelope in a pattern, the mechanical arrangement for supporting these electrodes is not necessary.

Furthermore, since the necessary leads are similarly formed on the inner surface of the glass envelope at the same time when the electrodes are formed thereon, it is not necessary to connect the leads to the electrodes so that the manufacturing of the image pick-up tube becomes easy.

In addition, since the electrodes are formed on the inner surface of the glass envelope, the apertures of the electrostatic lenses formed by the electrodes are substantially equal to the inner diameter of the glass envelope. Thus, distortion can be reduced and the characteristic such as aberration or the like can be improved as compared with that of the prior art image pick-up tube.

The above description is given on the preferred embodiments of the invention, but it will be apparent that many modifications and variations could be effected by one skilled in the art without departing from the spirits or scope of the novel concepts of the invention, so that the scope of the invention should be determined by the appended claims only.

I claim as my invention:

1. Image pick-up tube comprising:

(a) an envelope;

(b) an electron beam source positioned at one end of said envelope;

(c) a target positioned at another end of said envelope opposite to said electron beam source; and (d) at least one electrostatic lens means positioned between said electron beam source and said target, said lens means comprising a first electrode and a second electrode respectively deposited on the inner surface of said envelope, an electrode lead connected to said second electrode deposited on the inner surface of said envelope and extending across said first electrode but electrically isolated therefrom.

2. Image pick-up tube according to claim 1, wherein said lens means further comprises a third electrode which is also deposited on the inner surface of said envelope, said first, second and third electrodes forming a unipotential lens means.

3. Image pick-up tube according to claim 1, wherein said second electrode is divided into two pairs of deflection electrodes.

4. Image pick-up tube according to claim 1, wherein said second electrode is electrically connected to a mesh electrode forming a static collimation lens together with said first electrode for vertically impinging said electron beam on the whole area of said target.

* * * * *